US005282287A

United States Patent [19]

Aube

[11] Patent Number: 5,282,287

[45] Date of Patent: Feb. 1, 1994

[54] HAMMER WITH SHEET CARRYING GRIP

[76] Inventor: Larry Aube, 8750 Kester Ave., #2, Panorama City, Calif. 91402

[21] Appl. No.: 3,506

[22] Filed: Jan. 12, 1993

[51] Int. Cl.[5] ..... B25F 1/00

[52] U.S. Cl. ..... 7/146; 294/2; 294/24

[58] Field of Search ..... 7/143, 146, 147; 294/2, 294/24, 26, 15, 19

[56] References Cited

U.S. PATENT DOCUMENTS

| | | | |
|---|---|---|---|
| 74,401 | 2/1868 | Morris | 7/143 |
| 74,568 | 2/1868 | Meeker | 7/143 |
| 74,615 | 2/1868 | Shepard | 7/143 |
| 711,408 | 10/1902 | Maggard | 7/143 |
| 885,363 | 4/1908 | Myers | 7/143 |
| 1,308,694 | 7/1919 | Boswell | 7/143 |
| 2,729,127 | 1/1956 | Watanabe | 7/143 |
| 4,113,160 | 9/1978 | Spiers | 294/26 |

*Primary Examiner*—Roscoe V. Parker
*Attorney, Agent, or Firm*—Robert M. Sperry

[57] ABSTRACT

An improved hand tool having a plurality of semispherical projections, which can be attached to or formed integral with, the handle of a hammer and which enables a carpenter to use his hammer to quickly and easily carry sheet material and to hold the sheet material in place and to nail it without the loss of time entailed in setting his hammer down and subsequently retrieving it.

7 Claims, 2 Drawing Sheets

HAMMER WITH SHEET CARRYING GRIP

BACKGROUND

1. Field of Invention

This invention relates to hand tools and is particularly directed to improved hammers having grip members attached to the handle of the hammer to facilitate gripping scenery flats and sheet material, such as plywood, sheetrock, etc. for transportation.

2. Prior Art

In the theater industry, it is customary for stage carpenters and the like to construct scenery flats for backdrops and for simulating interior and exterior building walls and the like. These flats are composed of frameworks of 1×3 boards faced with ¼ inch plywood or the like and may be as large as 15×20 feet. To transport these flats from one location to another, requires several workmen. Moreover, once the flat is delivered to its desired location, it must be held in place while it is nailed in place by one or more workmen. Similarly, in the construction industry, it is customary for carpenters to erect a framework of 2×4 boards and, subsequently to cover the framework by nailing sheets of plywood, sheetrock or the like to the framework. However, the standard size for such sheets is 4×8 feet, which is too large, and often too heavy, for an individual to carry alone. Moreover, the sheets are usually shipped by truck, in bales containing approximately 60 sheets per bale, and the bales are delivered to a location near the worksite by forklift trucks or the like. Thereafter, the carpenters must open the bales and carry the sheets, one at a time, to the worksite for installation. For transporting both scenery flats and sheet material, it is necessary for the carpenter to lay down his hammer, in order to have both hands available for carrying the sheet material, and once the sheet has been carried to the worksite, it is often necessary for someone to hold the sheet in place while the carpenter retrieves his hammer in order to nail the sheet to the framing. Obviously, considerable time is lost by the carpenter in setting his hammer down and retrieving it. Numerous prior at devices have been proposed to overcome these problems. However, many of the prior art devices have been complex in structure and use and have been expensive to produce and purchase. Other prior art devices have been ineffective or have interfered with the use of the hammer for conventional purposes. Thus, none of the prior art devices have been entirely satisfactory.

BRIEF SUMMARY AND OBJECTS OF INVENTION

These disadvantages of the prior art are overcome with the present invention and a sheet-carrying device is proposed which is simple and inexpensive to produce, purchase and use, yet which enables a carpenter to use his hammer to quickly and easily carry sheet material to a worksite and which enables the carpenter to hold the sheet material in place and to nail it without the loss of time entailed in setting his hammer down and subsequently retrieving it and which does not adversely effect use of the hammer for conventional purposes.

These advantages of the present invention are preferably attained by providing an improved sheet-carrying device which can be attached to, or formed integral with, a hammer and which enables a carpenter to use his hammer to quickly and easily carry sheet material and to hold the sheet material in place and to nail it without the loss of time entailed in setting his hammer down and subsequently retrieving it.

Accordingly, it is an object of the present invention to provide an improved hand tool.

Another object of the present invention is to provide an improved hammer.

An additional object of the present invention is to provide an improved hand tool which enables a carpenter to use his hammer to quickly and easily carry sheet material and to hold the sheet material in place and to nail it without the loss of time entailed in setting his hammer down and subsequently retrieving it.

A further object of the present invention is to provide an improved hand tool which is simple and inexpensive to produce, purchase and use.

A specific object of the present invention is to provide an improved hand tool having a plurality of semispherical projections, which can be attached to or formed integral with, the handle of a hammer and which enables a carpenter to use his hammer to quickly and easily carry sheet material and to hold the sheet material in place and to nail it without the loss of time entailed in setting his hammer down and subsequently retrieving it.

These and other objects and features of the present invention will be apparent from the following detailed description, taken with reference to the figures of the accompanying drawings.

DETAILED DESCRIPTION OF THE INVENTION

Figure 1:
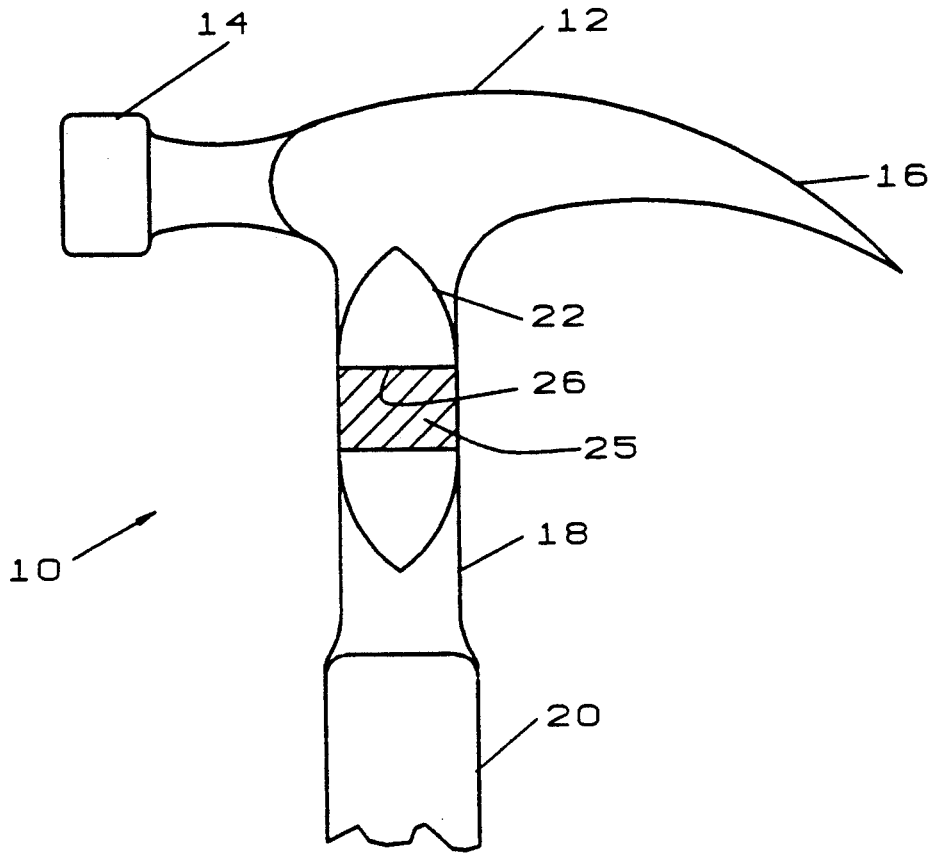
FIG. 1 is a side view of a hammer embodying the present invention.
Figure 2:
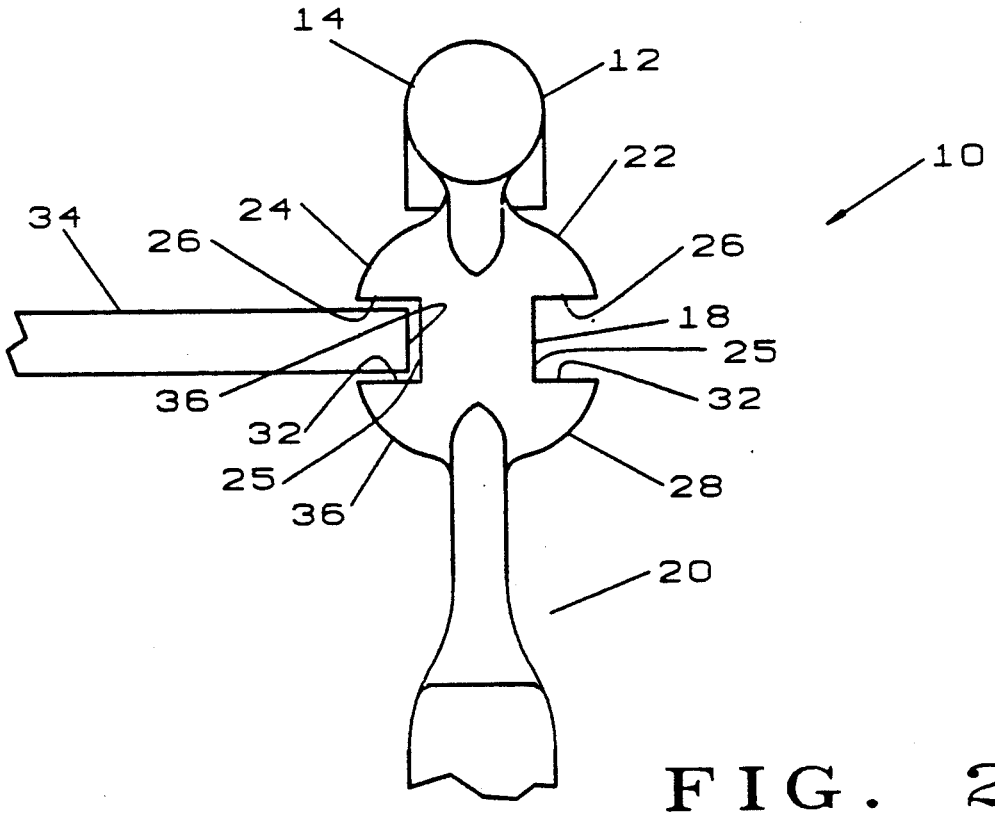
FIG. 2 is a front view of the hammer of FIG. 1.

In that form of the present invention chosen for purposes of illustration in the drawing, FIGS. 1 and 2 show a hammer, indicated generally at 10, having a head 12, with a driving end 14 and a claw end 16, mounted on a handle 18 which is formed with a hand grip 20. On each side of the handle are a pair of generally semispherical projections 22 and 24, extending laterally from the handle 18 adjacent the head 12 and having flat lower surfaces 26. Approximately one inch below the projections 22 and 24 are a second pair of projections 28 and 30, which are substantially mirror images of the projections 22 and 24 and which have flat upper surfaces 32. If desired, the spaces between the projections 22 and 28 and between the projections 24 and 30 may be provided with a friction-enhancing surface 25, which may be etched, grooved or otherwise roughened or may be provided with a coating of rubber or the like, to improved the grip of the projections 22, 24, 28 and 30 on an article inserted between them.

In use, the hammer 10 may be used, in a conventional manner, for driving and removing nails and the like. However, when it is necessary or desirable for the worker to transport a sheet of building material, such as sheet 34 of FIG. 2, he can insert one edge 36 of the sheet of material between the adjacent projections 22 and 28 or 24 and 30, to enable the hammer 10 becomes a handle to facilitate transporting the sheet 34. Once the sheet 34 has been delivered to the desired location, the worker can lean against the sheet 34 to hold it in place temporarily, while he starts a nail with one hand, and can use the hammer 10 in his other hand to drive the nail home and, thereby, affix the sheet 34 in its desired location. Because of the bulk of the sheet 34, a second worker may be needed to assist in transporting the sheet 34 to its desired location. However, once the sheet 34 has been delivered, the second worker can be released for other duties, while the first worker affixes the sheet 34 single-handedly, as described above. Thus greatly increases the efficiency of both workers, since the worker using the hammer 10 is not required to set the hammer 10 down, in order to transport the sheet 34, and to have the second worker hold the sheet 34 in place while he retrieves the hammer 10 for the nailing operation; while the second worker is need only for transporting the sheet 34 and is free for other work immediately upon delivering the sheet 34 to the desired location.

Figure 3:
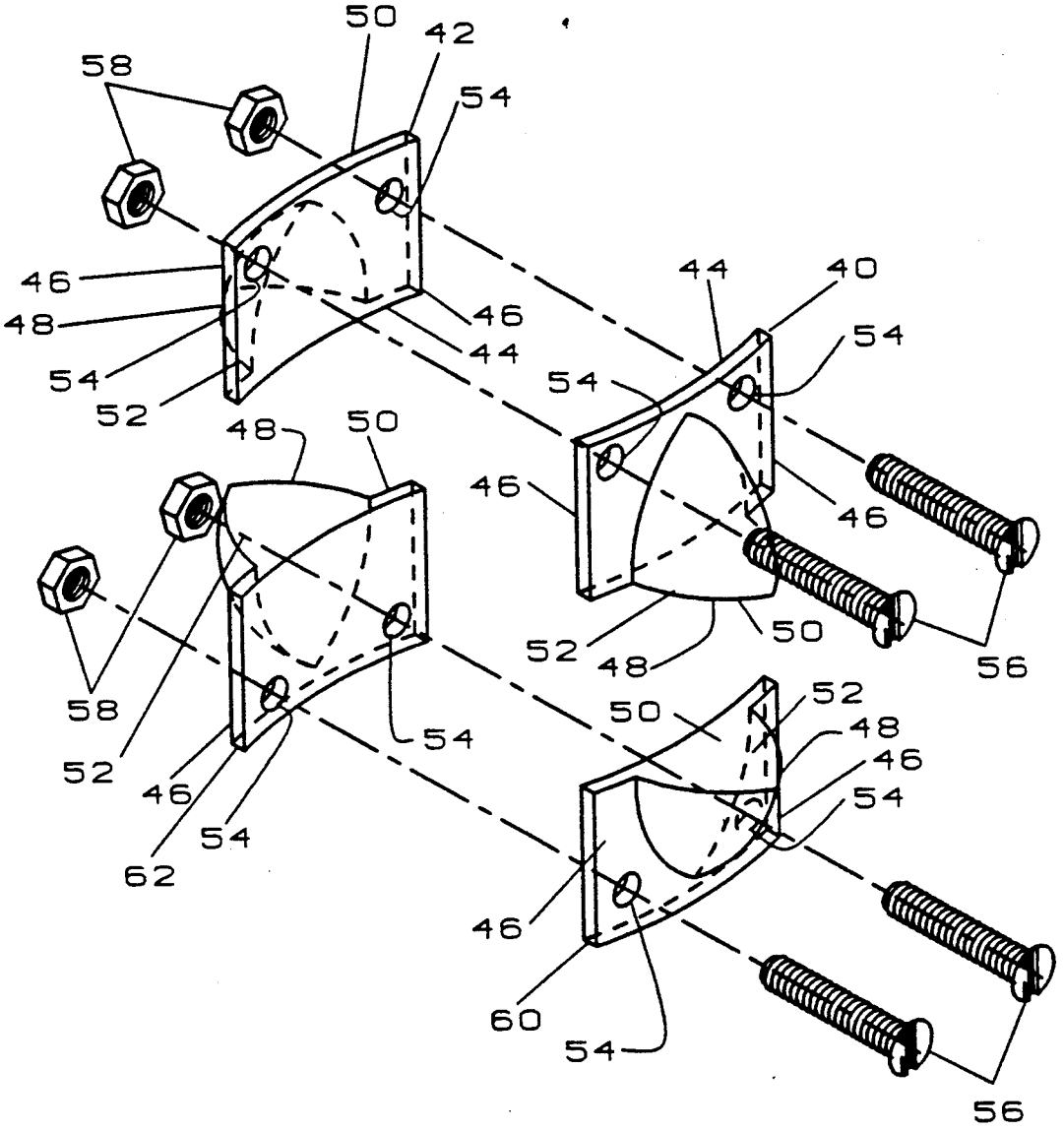
FIG. 3 is an exploded isometric view of a pair of attachments for a hammer embodying the present invention.

FIG. 3 shows an alternative form of the present invention comprising a first pair of members 40 and 42 having arcuate inner surfaces 44 with flanges 46 projecting laterally from each side and having semispherical projections 48 formed on the outer surfaces 50. The projections 48 are formed with downwardly-facing flat surfaces 52 and holes 54 are provided in the flanges 46 to accommodate bolts 56 or the like, which may be releasably retained, as by nuts 58, to secure the members 40 and 42 together, in clamping relation, about the handle of a conventional hammer. A second pair of members 60 and 62, identical to the members 40 and 42, are secured to the hammer handle with their flat surfaces 52 facing upward and spaced approximately one inch below the members 40 and 42. This permits the members 40, 42, 60 and 62 to be clamped onto a conventional hammer to convert the conventional hammer, as a retrofit, for use in transporting sheet material in the manner described above with respect to hammer 10 of FIGS. 1 and 2.

Obviously, numerous other variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A hand tool comprising:

a hammer having a head and a handle, and at least two generally semispherical members formed integral with said handle and projecting from said handle in spaced relation along said handle and having flat surfaces on the facing surfaces of said members.

2. The tool of claim 1 wherein:

said members are spaced approximately one inch apart along the length of said handle.

3. The tool of claim 1 wherein:

at least one of said members is mounted adjacent said head of said hammer.

4. The tool of claim 1 wherein:

four of said members are provided mounted in pairs on opposing sides of said handle.

5. The tool of claim 1 wherein:

said members are releasably securable to said handle.

6. A tool attachment comprising:

a pair of members having arcuate inner surfaces formed with laterally extending flanges and formed with generally semispherical projections on the outer surfaces of said members, and means for releasably securing said members in clamping relation about the handle of a hand tool.

7. The tool attachment of claim 6 wherein:

said projections are each formed with one flat surface.

* * * * *